United States Patent [19]

Michael

[11] 4,089,096

[45] May 16, 1978

[54] METHOD OF MAKING SCHOOL RING TOP

[76] Inventor: John Graham Michael, 431 Parkview Dr., Wynnewood, Pa. 19096

[21] Appl. No.: 714,090

[22] Filed: Aug. 13, 1976

[51] Int. Cl.[2] ..... B23P 13/00

[52] U.S. Cl. ..... 29/160.6; 63/2; 63/15; 63/23

[58] Field of Search ..... 29/160.6; 63/15, 2, 63/23, 26; 156/58, 230, 256, 514, 233, 247, 234; 96/47, 78, 27, 67

[56] References Cited

U.S. PATENT DOCUMENTS

| | | | |
|---|---|---|---|
| 418,674 | 1/1890 | Baynes | 96/27 R X |
| 1,996,768 | 4/1935 | Ingman | 96/63 X |
| 2,145,071 | 1/1939 | Cave | 63/15 X |
| 2,181,507 | 11/1939 | Chickering | 63/15 |
| 2,302,561 | 11/1942 | Libby et al. | 156/514 |
| 3,599,359 | 8/1971 | Michael | 63/1 R X |
| 3,732,134 | 5/1973 | Michael | 29/160.6 X |

*Primary Examiner*—Victor A. DiPalma
*Attorney, Agent, or Firm*—Smith, Harding, Earley & Follmer

[57] ABSTRACT

In school jewelry such as school rings, bezel ring top keys, and ring top charms used as souvenirs and prom favors, a school ring top is provided having a beveled bezel and a stone with a faceted pavilion. The school ring top closely simulates the appearance of a die struck or cast ring top and provides clear and legible letters spelling out school-related information in its bezel which is made from a developed photographic film sheet with a reflecting backing layer. The bezel is slanted and of sufficient height for easy reading from a side view as well as a top view, and for accommodating a stone with a faceted pavilion. Three methods of making the miniature ring top are disclosed. One method includes doming the bezel by applying pressure to form a dome section, and then cutting a bezel out of the dome section. A second method includes cutting a bezel strip, removing a pie section from the bezel strip, and then doming by placing the ends of the pie section together. The third method includes doming and cutting the bezel substantially simultaneously in one operation so that the domed sections are never out of registration with the image on the bezel section of the photographic film sheet.

13 Claims, 22 Drawing Figures

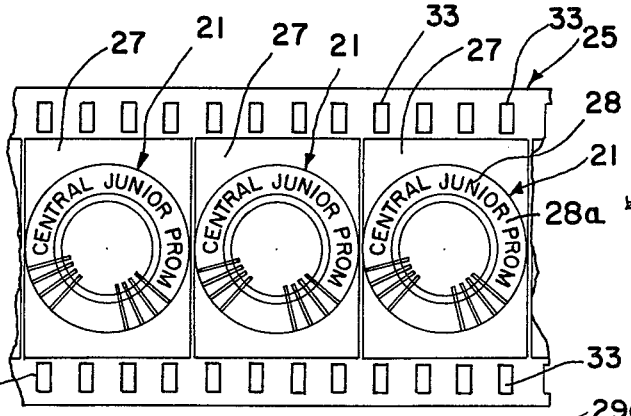
FIG. 1
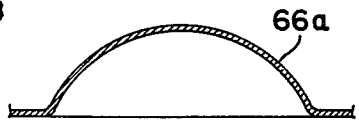
FIG. 6
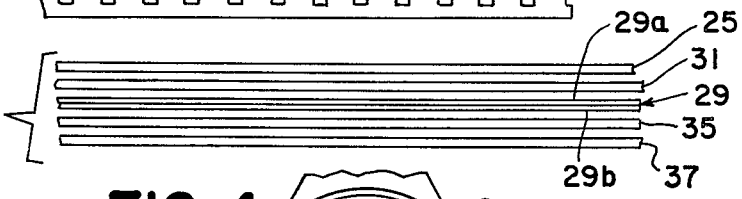
FIG. 2
FIG. 4
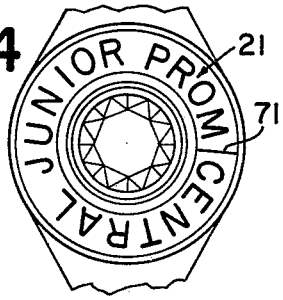
FIG. 3
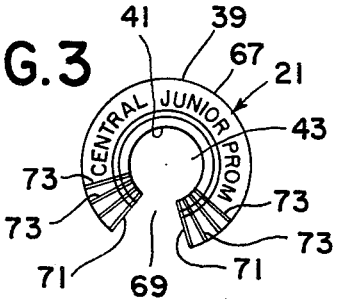
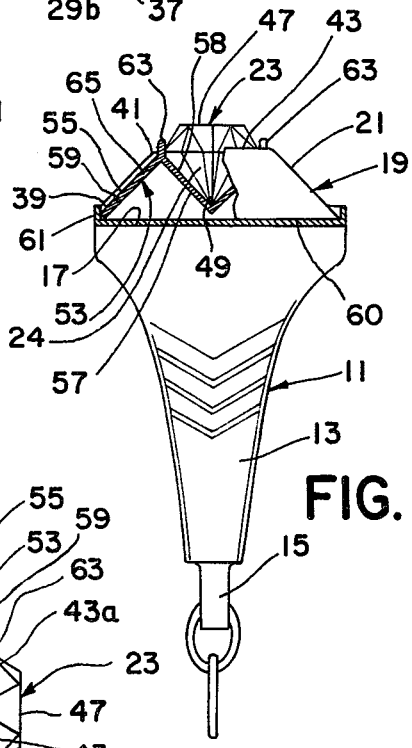
FIG. 5
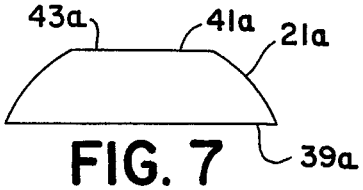
FIG. 7
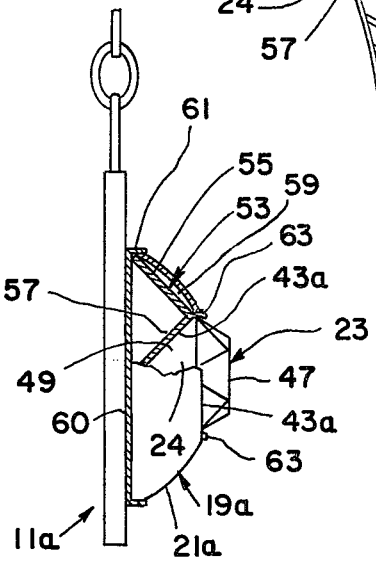
FIG. 8
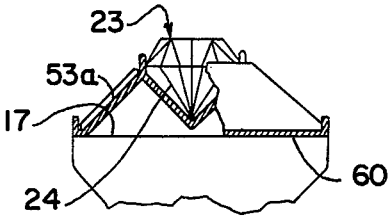
FIG. 9
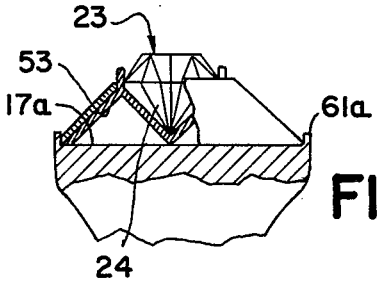
FIG. 10

FIG. 17
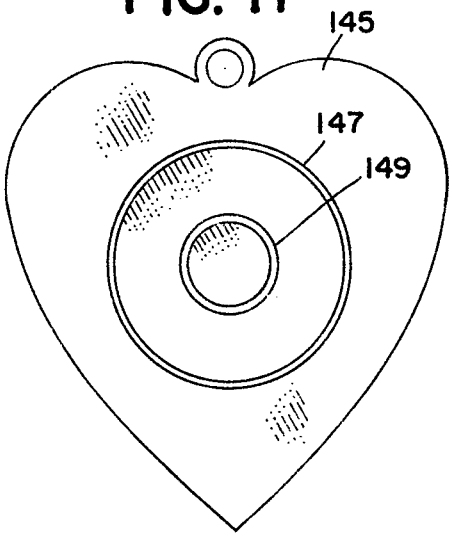
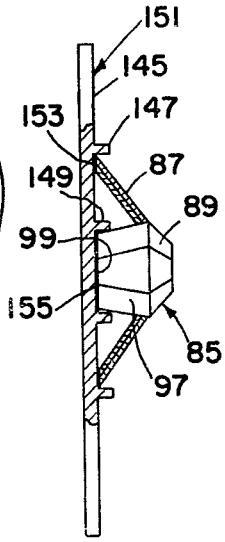
FIG. 18
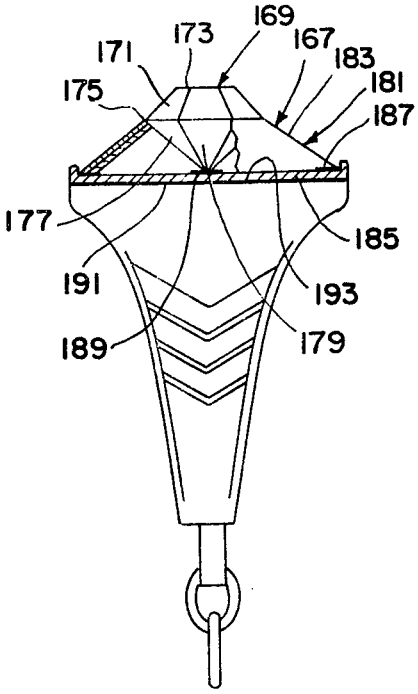
FIG. 21
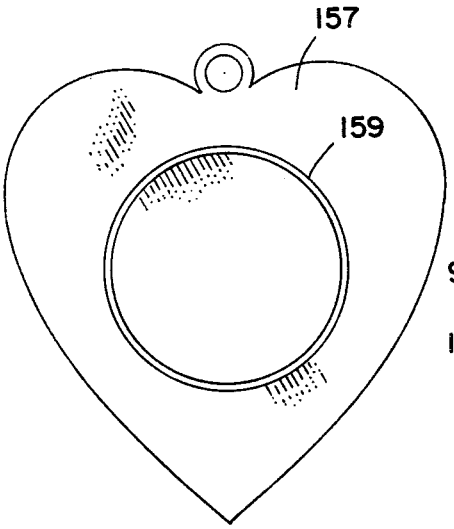
FIG. 19
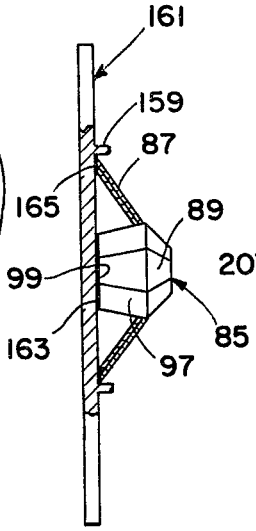
FIG. 20
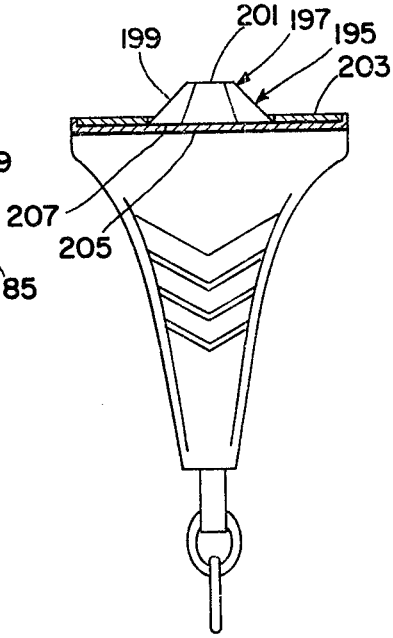
FIG. 22

METHOD OF MAKING SCHOOL RING TOP

CROSS-REFERENCE TO RELATED APPLICATIONS

The subject matter of this patent application is related to the subject matter in my U.S. Pat. Nos. 3,599,359 issued on Aug. 17, 1971, and 3,732,134 issued on May 8, 1973, which are incorporated herein by reference.

BACKGROUND OF THE INVENTION

This invention relates to school jewelry and the like such as miniature school rings, bezel keys, and charms that feature school ring tops and are used as souvenirs or prom favors.

My previous U.S. Pat. Nos. 3,599,359 and 3,732,134, disclose a miniature school ring having a bezel with sharp, clear and legible characters that give school-related information. By "bezel" here is meant the annular portion of the ring top surrounding the stone and on which intelligence appears, such as: "Central High School 1976." The ring is easily personalized to display the individual school and class year because its manufacture does not require the making of a stamping die or casting mold such as was required by the prior art. However, the bezels of my previous ring tops were not high enough to accommodate a stone with a faceted pavilion or faceted point. Such stones are used in regular die struck or cast class rings because of their greater brilliance as compared to a stone with a flat base. The bezels of my previous ring tops were not slanted enough to be read from the side view so that they were inferior to the regular die struck or cast school ring tops in this respect.

SUMMARY OF THE INVENTION

It is an object of this invention to provide a school ring top which more closely simulates the appearance of a conventional school ring top but which is not made from a casting mold. It is another object to provide a school ring top having substantially the same shape bezel as the bezel of the conventional school ring, and which accommodates a stone with a faceted pavilion.

These objects are accomplished by beveling the bezel of my previous patents. The beveling may be done by applying pressure to a developed photographic film frame to form a dome, and then cutting out the bezel; or by cutting out a flat bezel strip, removing a pie shaped piece from the strip, and then bringing the ends of the bezel strip together to form a beveled bezel. A third method of beveling may be accomplished by affixing a supporting plastic or metal sheet to the reflective film frame and applying pressure to bevel the bezel while substantially simultaneously cutting out the bezel.

Also, a bezel support may be provided having supporting walls in the shape of a truncated cone for seating the bezel, and provided with a central cup for receiving the faceted pointed stone.

BRIEF DESCRIPTION OF THE DRAWINGS

Other objects and advantages of the invention, including its simplicity and economy, will further become apparent hereinafter and in the drawings, in which:

FIG. 1 is a view in top plan of several frames of a developed photographic film negative of school-related information or indicia that is to appear in the bezel of a miniature ring top in school jewelry;

FIG. 2 is a view in side elevation of the developed film negative and the sheets which are attached thereto in the course of making the bezel;

FIG. 3 is a view in top plan of an annular bezel strip cut from a film frame, with a pie section removed from the strip;

FIG. 4 is a view in top plan of a miniature ring top constructed in accordance with this invention and is a top view of FIG. 5;

FIG. 5 is a view in side elevation and partly in section of the miniature ring top mounted on the top portion of miniature school ring;

FIG. 6 is a view in section of a film frame which has been domed by placing it in a die and applying pressure;

FIG. 7 is a view in side elevation of a ring bezel cut from the domed film frame of FIG. 6;

FIG. 8 is a view in side elevation and partly in section of the bezel of FIG. 7 in a ring top mounted on a bezel charm used as a prom souvenir;

FIG. 9 is a partial view similar to FIG. 5 of an alternative support base from that shown in FIGS. 5 and 8;

FIG. 10 is a view similar to FIG. 9 of another alternative support base;

FIG. 17 is a front view of a charm base having an outer and innner rim stamped therein;

FIG. 18 is a view in side elevation and partly in section of a prom souvenir with a ring top mounted on the charm base of FIG. 17;

FIG. 19 is a front view of a charm base having an outer rim only stamped therein;

FIG. 20 is a view in side elevation and partly in section of a prom souvenir with a ring top mounted on the charm base of FIG. 19;

FIG. 21 is a view in side elevation and partly in section of a ring top made with the beveled bezel of FIG. 13 and a pointed stone, and mounted on the top portion of a school ring; and FIG. 22 is a view in side elevation and partly in section of a ring top made with a flat bezel and flat stone.

DESCRIPTION OF THE PREFERRED EMBODIMENTS

Figure 11:
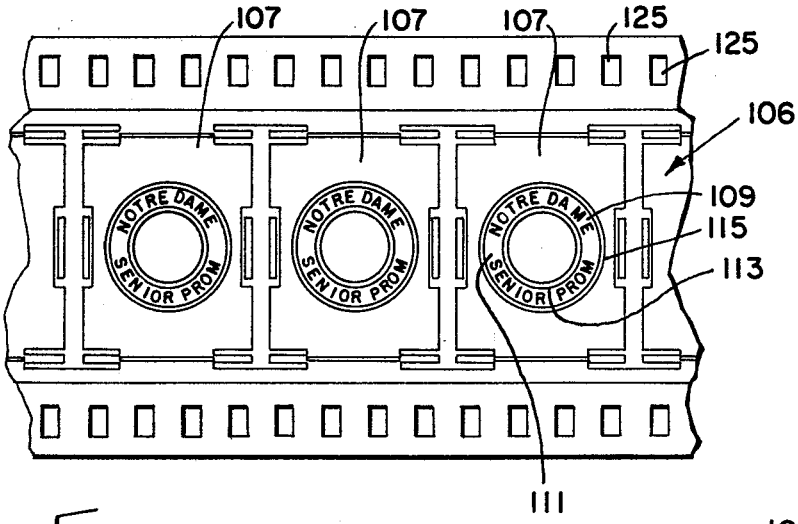
FIG. 11 is a view in top plan of several frames of a developed photographic film negative of school-related information that is to appear in a beveled bezel of a ring top.
Figure 12:
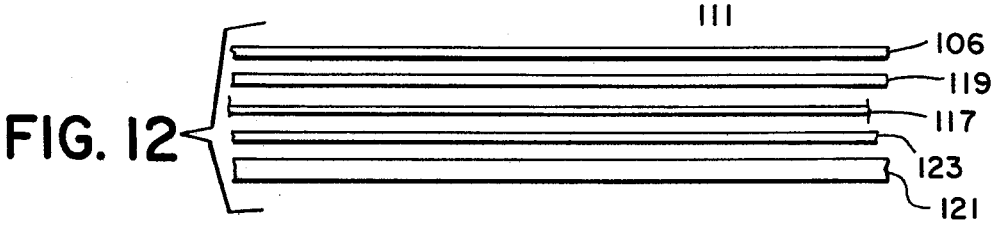
FIG. 12 is a view in side elevation of the developed film negative of FIG. 11 and the sheets which are attached thereto in the course of making the beveled bezel in accordance with a third method of the invention.

Turning now to the specific embodiments of the invention selected for illustration in the drawings, there is shown, in FIG. 5, a miniature school ring 11 having a shank 13 with an eye 15 extending therefrom for attachment to a chain, and a flat top portion 17 on which is mounted a ring top 19 constructed in accordance with this invention. The ring top 19 includes a beveled bezel 21 and a stone 23 with a faceted pavilion 24.

Bezel 21 is made of a developed photographic film sheet 25, as shown in FIG. 1, having a series of frames 27 that are all substantially identical and contain thereon filmed intelligence 28, such as artwork, school insignia, or school-related information. For example, CENTRAL JUNIOR PROM appears in the film sheet 25 as transparent letters 28 against a constrasting color background 28*a*. As shown in FIG. 2, a reflecting backing is provided for the letters 28 by a reflecting backing sheet 29 which may have transparent layers 29*a* and a reflecting backing layer 29*b*. Reflecting backing sheet 29 is attached to the developed film sheet 25 by a first bonding layer 31 of a transparent adhesive. Photographic film sheet 25 may be dyed a desired color, gold or silver for example, or transparent layer 29*a* may be dyed the desired color, so that the light reflected by reflecting backing layer 29*b* appears to the eye as gold or silver.

The film 25 has sprocket holes 33 that are used to advance the film in the camera to take a series of substantially identical photographs of the intelligence 28, and are also used to precisely position the film frames 27 for subsequent steps in the method of forming a bezel. For example, the sprocket holes are used to precisely position the film frame when doming a selected portion of the frame by applying pressure and sometimes heat, and when cutting the outer and inner edges of the bezel.

The reflecting backing layer 29*b* reflects a metallic color and for this purpose the transparent color layer 29*a* may be impregnated with a coating of transparent yellow dye, and the reflecting layer 29*b* may be a sheet of silver. A second adhesive layer 35 is applied to reflecting backing sheet 29 so that the bezel cut from the combined sheets 25, 29 is completely coated with the adhesive for applying the bezel to a support base. A cover sheet 37 is applied to adhesive layer 35 to protect it until the bezel is applied to the support base at which time cover sheet 37 is peeled off. Second adhesive layer 35 is made of a pressure sensitive adhesive.

Bezel 21, as seen in FIG. 5, is beveled and has a larger perimeter bottom edge 39 and a smaller perimeter top edge 41 with the bezel surface slanting inwardly from its larger bottom edge 39 towards the smaller top edge 41. A central recess 43 is defined by bezel top edge 41, and stone 23, having a crown 47 and a pavilion 49 that is pointed and provided with facets for increasing the reflections and brilliance of the stone, is mounted in central recess 43.

A support base 53 is provided for supporting the stone 23 and the bezel 21. Support base 53 includes outer walls 55 shaped like a truncated cone so as to support the bezel 21 in proper position, and a central recess cup 57 formed in the support base 53 for supporting and seating the pointed stone 23. An adhesive layer 58 joins the stone 23 to cup 57. Adhesive layer 59, which may be adhesive layer 35 of FIG. 2, affixes bezel 21 to walls 55 of support base 53.

The support base 53 is adhesively seated on a bottom plate 60 having a rim 61, and a top rim 63 is formed at the top of walls 55 around cup 57. The rims 61 and 63 form a bezel channel 65 with wall 55 for receiving and supporting the bezel 21. Bottom plate 60 is adhesively mounted on top flat portion 17 of ring 11. If desired, a support base 53*a* may be formed integrally with bottom plate 60 as shown in FIG. 9, or the bottom plate 60 may be eliminated and a bottom rim 61*a* may extend upwardly from a top flat portion 17*a* of the ring, and be formed integrally therewith, as shown in FIG. 10.

As shown in FIG. 3, bezel 21 is formed of a flat bezel strip 67 having an annular shape with a pie section 69 cut out to form ends 71 which abut when brought together. Radial lines 73 provide a decorative effect and also conceal the butt joint formed by ends 71.

A first method of making a multiplicity of substantially identical ring tops 19 for school jewelry such as miniature school rings 11, keys 11*a*, and charms, comprises the steps of photographing the artwork on a series of film frames 27 having sprocket holes 33 so that the artwork or intelligence 28 on each frame 27 is registered with respect to the sprocket holes 33, developing the film sheet 25 to obtain a roll of developed film frames 27 with intelligence 28 and background 28*a* thereon with a portion 28 of said film 25 being transparent, affixing a reflecting backing 29 to the back of said film frames 27 so as to reflect through said transparent portion 28 of the film 25, cutting out an annular member from said backed frame 27, cutting out a pie section 69 from said annular member to form a bezel strip 67 having an annular shape with a pie section 69 cut out and having ends 71 which abut when brought together, forming a ring bezel with the strip 67 by affixing the bezel strip 67 to outer walls 55 of a support base 53 having its outer walls 55 in the shape of a truncated cone to support the bezel strip 67 in the form of a ring bezel with said strip ends 71 abutting, and having a larger base edge 39 and a smaller top edge 41 with the bezel wall surface slanting inwardly from its larger base edge 39 toward the smaller top edge 41 so as to clearly display the photographed artwork or intelligence 28 on the bezel 21, forming a central recess 43 with the top edge 41 of the bezel 21, with the height of said bezel 21 from the base edge 39 to top edge 41 being sufficient to accommodate a faceted pointed stone 23, applying an adhesive layer 58 to cup 57, positioning said pointed stone 23 in said bezel central recess 43, and adhesively affixing said stone 23 by adhesive layer 58 to cup 57 of the support base 53.

The method may include the step of dyeing photographic film sheet 25 or transparent layer 29*a* with a yellow dye to simulate gold.

The method may also include the steps of applying a pressure sensitive adhesive layer 35 and cover sheet 37 to the reflecting backing 29 before cutting out the bezel strip 67, and removing the cover sheet 37 before adhesively affixing the bezel strip 67 to the support base 53. The method may further include the step of adhesively affixing the ring top 19 to the top portion 17 of a miniature school ring 11.

A second method of making a multiplicity of substantially identical ring tops 19*a*, FIG. 8, for school jewelry such as miniature school rings 11, keys 11*a*, and charms, comprises the steps of photographing artwork 28 on a series of film frames 27 having sprocket holes 33 so that the artwork 28 on each frame 27 is registered with respect to the sprocket holes 33, developing the film 25 to obtain a roll of developed film frames 27 with intelligence 28 and background 38*a* thereon with portion 28 of said film 25 being transparent, affixing a reflecting backing 29 to the back of the film frames 27 so as to reflect through said transparent portion 28 of the film 25, doming the center portion of the film frame 27 by applying pressure to form a domed section 66*a*, cutting a top perimeter edge 41*a* into the top of the domed section 66*a* to form a central recess 43*a* and cutting a base perimeter edge 39a at the base of the domed section 66a to form a bezel 21a with the bezel wall surface slanting inwardly from its larger base perimeter edge 39a toward its smaller perimeter top edge 41a so as to clearly display the photographed artwork 28, and with the height of said bezel 21a from base 39a to top 41a being sufficient to accommodate a faceted pointed stone 23a, adhesively affixing said bezel 21a to a support base 53, applying an adhesive layer 58 to cup 57, positioning the pointed stone 23 in said bezel central recess 43a, and adhesively affixing the stone 23a to the support base 53.

The method may include the step of dyeing photographic film sheet 25 or transparent layer 29a with a yellow dye to simulate gold.

The second method may also include the steps of applying a pressure sensitive adhesive layer 35 and a cover sheet 37 to the reflecting backing 29 before doming the center portion of the backed film frame 27, pressing the center portion of the backed film frame 27 into a domed section while cover sheet 37 is on and before cutting the bezel perimeter edges 39a and 41a, and removing the cover sheet 37 from bezel 21a before affixing the bezel 21a to the support base 53. The second method may further include the step of adhesively affixing the ring top 19a to the top portion 17 of a miniature ring or to a key 11a, FIG. 8.

Turning now to the third embodiment of the invention illustrated in FIGS. 11 through 21, there is shown a school ring 77 having a shank 79 with an eye 81 extending therefrom for attachment to a chain, and a flat top portion 83 on which is mounted a ring top 85 constructed in accordance with the third embodiment of the invention. The ring top 85 includes a beveled bezel 87 and a stone 89.

The stone 89 includes a faceted crown 91 with a table 93, girdle 95, and a faceted pavilion 97 with its apex cut off to form a culet 99, which is affixed, as by an adhesive layer 101 to the top surface of a bottom plate 102 having an outer rim 103 and an inner rim 104. The bottom surface of bottom plate 102 is attached to and mounted on flat top portion 83 of ring 77 by an adhesive layer 105.

Bezel 87 is made of a developed photographic film sheet 106 having a series of frames 107 that are all substantially identical and contain thereon filmed intelligence or indicia 109, such as artwork, school insignia, or school-related information. For example, NOTRE DAME SENIOR PROM appears on film sheet 106 as transparent letters 109 against a contrasting color background 111.

Intelligence 109 is framed between inner border 113 and outer border 115. Intelligence 109 and the borders 113, 115 are transparent.

A reflecting backing is provided for the transparent letters 109 and the borders 113, 115 by a reflecting backing sheet 117. Reflecting backing sheet 117 may be a sheet of silver and may be attached to the lower surface of photographic film sheet 106 by an adhesive layer 119, which may be a transparent, pressure-sensitive adhesive. Photographic film sheet 106 may be dyed a desired color, such as yellow, so that the reflected light causes intelligence 109 and borders 113, 115 to appear to be a gold color.

Alternatively, instead of dyeing the photographic film sheet 106, a laminated reflecting backing sheet 29 may be used having a dyed transparent color layer 29a and a reflecting backing layer 29b as in embodiments one and two of the invention.

Film sheet 106 and reflecting backing sheet 117 are attached together and are strengthened or reinforced by a support means which comprises a supporting plastic or metal sheet 121 attached to the bottom surface of reflecting backing sheet 117 by an adhesive layer 123.

Photographic film sheet 106 is provided with sprocket holes 125 that are used when advancing the film in the camera to take the series of substantially identical photographs of the artwork, including intelligence 109, and are also used in making the beveled bezel to precisely position the frame 107 during subsequent steps in the third method of forming a beveled bezel.

The third method of making a multiplicity of substantially identical ring tops 85 for school jewelry such as miniature school rings 77, keys and charms, comprises the steps of photographing intelligence or artwork 109 and borders 113, 115 on a series of photographic film frames 107 having sprocket holes 125 so that the artwork 109 on each frame 107 is registered with respect to the sprocket holes 125, developing the film 106 to obtain a roll of developed film frames 107 with the intelligence 109 and borders 113, 115 being transparent against a colored background 111, affixing a reflecting backing sheet 117 onto the back surface of the frames 107 so as to reflect light through the transparent portions 109, 113, and 115 of the developed film sheet 106, affixing a strengthening or reinforcing support sheet 121 to the back surface of the reflecting backing 117 as by using an adhesive layer 123, and beveling or doming the center portion of the supported film frame 107 by applying pressure in a die to form a beveled bezel 87 while, in the same operation, cutting a top perimeter edge 127 and a bottom perimeter edge 129. Top edge 127 is smaller than bottom edge 129 so that the beveled wall slopes or slants inwardly from its larger bottom edge 129 towards the smaller top edge 127 to clearly display the photographed artwork 109. The height of the bezel 87 from its bottom edge 129 to top edge 127 is sufficient to accommodate stone 89 having a faceted pavilion 97 with its apex removed to form a culet 99.

Beveled bezel 87 and its support sheet 121 are mounted on bottom plate 102 as by an adhesive layer 130. An adhesive layer 101 is applied to the top surface of plate 102, and stone 89 is positioned with its culet 99 in contact with adhesive layer 101 and is seated within top edge 127 of beveled bezel 87. Inner border 113 simulates the top rim of a bezel channel. The color of support sheet 121 may be the same as the top surface of bottom plate 102 so that an exact fit between bottom edge 129 of beveled bezel 87 and rim 103 of bottom plate 102 is not required. Also, the stone 89 can "float" or move to accommodate minor variations in bezel shape. Further, selfsupporting bezel 87 eliminates the need for the bezel slope to match the slope of the outer walls 55 of a support base 53.

Figure 15:
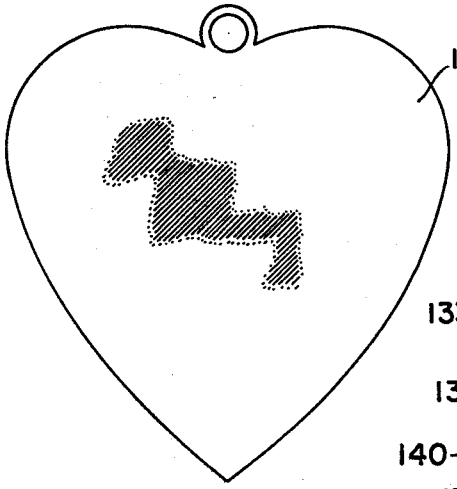
FIG. 15 is a front view of a charm base before a ring top is mounted thereon.
Figure 16:
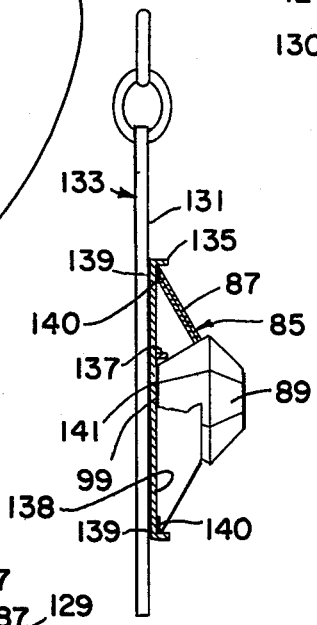
FIG. 16 is a view in side elevation and partly in section of a ring top with beveled bezel mounted on the charm base of FIG. 15 and used as a prom souvenir.
Figure 13:
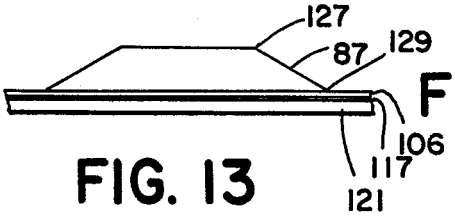
FIG. 13 is a view in side elevation of a beveled bezel which is cut and beveled in accordance with the third method.

FIG. 15 shows a heart-shaped charm base 131, and FIG. 16 shows a heart-shaped charm 131 which includes a ring top 85 mounted on charm base 131, with the ring top 85 having an outer rim 135 and an inner rim 137 extending from a bottom plate 138. Ring top 85 is mounted on charm base 131 by an adhesive layer 139, stone 89 is mounted on the bottom plate 138 within inner rim 137 by an adhesive layer 141 that contacts the culet 99 of stone 89, and beveled bezel 87 is mounted on bottom plate 138 by adhesive layer 140.

FIG. 17 shows a front view of a heart-shaped charm base 145 having an outer rim 147 and an inner rim 149 stamped therein. FIG. 18 is a view in side elevation and partly in section of a prom souvenir in the form of a charm 151 made from charm base 145 and including a ring top 85 with a stone 89 having a faceted pavilion 97 with a culet 99, and having a beveled bezel 87. The bottom of bezel 87 is attached to charm base 145 as by an adhesive layer 153 which is spread inside the circumference of outer rim 147. The stone 89 is attached to charm base 145 by an adhesive layer 155 which is spread on the charm base surface within the confines of inner rim 149.

FIG. 19 shows a front view of a charm base 157 having an outer rim 159 stamped therein and having no inner rim.

FIG. 20 is a view in side elevation and partly in section of a prom souvenir in the form of a charm 161 having a ring top 85 mounted on charm base 157. Ring top 85 includes a stone 89 with a faceted pavilion 97 and a culet 99. Stone 89 is attached to charm base 157 by an adhesive layer 163 which is spread around the central portion within outer rim 159. Beveled bezel 87 is attached to charm base 157 by an adhesive layer 165 which is spread on the surface of the charm base within the confines of the outer rim 159.

Figure 14:
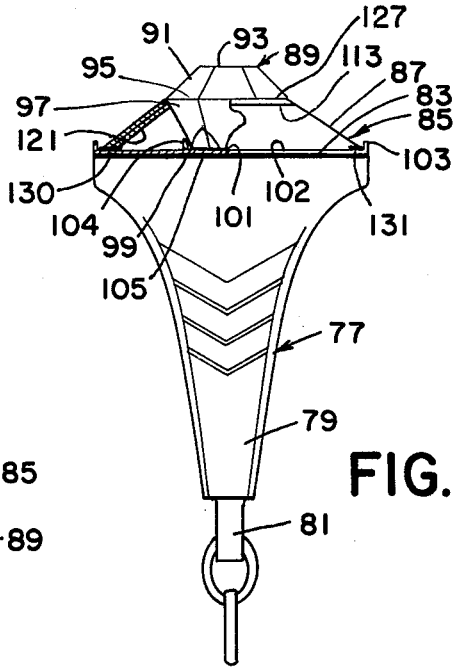
FIG. 14 is a view in side elevation and partly in section of a ring top made from the beveled bezel of FIG. 13 and mounted on the top portion of a miniature school ring.

FIG. 21 is a view in side elevation and partly in section similar to FIG. 14, except that it shows a school ring 167 having a pointed stone 169 with a faceted crown 171 having a table 173, a girdle 175, and a faceted pavilion 177 terminating in a point 179.

Pointed stone 169 forms an element in a ring top 181 that includes a beveled bezel 183 made in accordance with the method of making beveled bezel 87, but with slightly more bezel in order to accommodate the pointed stone. Beveled bezel 183 is attached to a bottom plate 185 by an adhesive layer 187, the bottom point of stone 169 is attached to bottom plate 185 by an adhesive layer 189, and the bottom plate 185 is attached to flat top portion 191 of the ring by an adhesive layer 193.

To show the important difference between the beveled bezel of the present invention, and the flat bezel of previous miniature school rings, FIG. 22 shows a view in side elevation and partly in section of a school ring having a ring top 195 that includes a flat stone 197 having a faceted crown 199 and a flat top 201, but having no pavilion at all.

Ring top 195 includes a bezel 203 which is flat. Stone 197 and bezel 203 are attached to a bottom plate 205 by an adhesive layer 207.

A comparison of the ring of FIG. 21 with the ring of FIG. 22 shows that the information on the beveled bezel 183 is readily visible and is discernible from the side, whereas the information on flat bezel 203 is not discernible to the eye when looking from the side but is discernible only when viewed from the top of the ring top.

I claim:

1. A method of making a multiplicity of substantially identical ring tops for school jewelry such as school rings, keys, and charms, comprising the steps of photographing artwork on a series of film frames having sprocket holes so that the artwork on each frame is registered with respect to the sprocket holes, developing the film to obtain a roll or developed photographic film frames with intelligence and background thereon with a portion of said film being transparent, affixing a reflecting backing to the back of said film frames to form reflective film frames that reflect light through said transparent portion of the film, forming beveled bezels from said reflective film frames, and supporting said bezels by attaching them to support means.

2. The method of claim 1, including forming said beveled bezels by doming the center portion of said film frames by applying pressure to the film, and cutting outside and inside edges of the bezel.

3. The method of claim 2, including doming said bezel and cutting said bezel edges in one operation while holding said film frame stationary.

4. The method of claim 1, including cutting out an annular member from said reflective frame, cutting out a pie section from said annular member to form a bezel strip having ends, forming a beveled bezel with the strip by bringing the ends into abutment, affixing the bezel to outer walls of a support base having its outer walls in the shape of a truncated cone, forming a central recess with the top edge of the bezel, with the height of said bezel from base edge to top edge being sufficient to accommodate a stone having a faceted pavilion, positioning said stone in said bezel central recess, and affixing said stone to the support base.

5. The method of claim 4, including applying a pressure sensitive adhesive layer and cover sheet to the reflecting backing before cutting out the bezel strip, and removing the cover sheet before affixing the bezel strip to the support base.

6. The method of claim 4, including affixing the ring top to a top portion of a miniature ring or the like.

7. The method of claim 1, including doming the center portion of the backed film frame to form a domed section, cutting a top perimeter edge into the top of the domed section to form a central recess and cutting a bottom perimeter edge at the bottom of the domed section to form a beveled bezel, with the height of said bezel from base to top being sufficient to accommodate a stone with pavilion facets, affixing said bezel to a support base, positioning a stone with a faceted pavilion in said bezel central recess, and affixing said stone to the support base.

8. The method of claim 7, including applying a pressure-sensitive adhesive layer and cover sheet to the reflecting backing before doming the center portion of said reflective film frame, pressing the center portion of said covered film frame into a domed section, and removing the cover sheet before affixing the bezel to the support base.

9. The method of claim 7, including affixing the ring top to the top portion of a miniature ring or the like.

10. A method of making a multiplicity of substantially identical ring tops for school jewelry such as school rings, keys, and charms, comprising the steps of photographing artwork on a series of film frames having sprocket holes so that the artwork on each frame is registered with respect to the sprocket holes, developing the film to obtain a roll of developed photographic film frames with intelligence and background thereon with a portion of said film being transparent, affixing a reflecting backing to the back of said film frames to form reflective film frames that reflect light through said transparent portion of the film, affixing a supporting film sheet to the back surface of said reflective film frames, and forming beveled bezels from said supported reflective film frames.

11. The method of claim 10, including forming said beveled bezels by doming the center portion of said film frames by applying pressure to the film, cutting outside and inside edges of the bezel, and doming said bezel and cutting said bezel edges in one operation by holding said film frames stationary.

12. The method of claim 10, including affixing said bezel to a support base, positioning a stone having a faceted pavilion within a central recess formed by said bezel, and affixing said stone to the support base.

13. The method of claim 10, including affixing the ring top to the top portion of a miniature ring or the like.

* * * * *